US009820554B2

(12) United States Patent
Hunt et al.

(10) Patent No.: US 9,820,554 B2
(45) Date of Patent: Nov. 21, 2017

(54) LID OF A BACKPACK

(71) Applicant: Thule IP AB, Malmö (SE)

(72) Inventors: Trevor Hunt, Garibaldi Highlands (CA); Damien Kelly, Squamish (CA); Henrik Kax, Stockholm (SE)

(73) Assignee: Thule IP AB, Malmö (SE)

( * ) Notice: Subject to any disclaimer, the term of this patent is extended or adjusted under 35 U.S.C. 154(b) by 133 days.

(21) Appl. No.: 14/687,334

(22) Filed: Apr. 15, 2015

(65) Prior Publication Data

US 2015/0296961 A1 Oct. 22, 2015

(30) Foreign Application Priority Data

Apr. 16, 2014 (EP) ..... 14165009

(51) Int. Cl.

| | |
|---|---|
| ***A45F 3/04*** | (2006.01) |
| ***A45F 3/02*** | (2006.01) |
| ***A45C 7/00*** | (2006.01) |
| ***A45C 9/00*** | (2006.01) |
| *A45F 4/02* | (2006.01) |

(52) U.S. Cl.

CPC ..... *A45F 3/02* (2013.01); *A45C 7/0086* (2013.01); *A45C 9/00* (2013.01); *A45F 3/04* (2013.01); *A45C 2009/007* (2013.01); *A45F 2004/023* (2013.01)

(58) Field of Classification Search

CPC ... A45C 7/0086; A45C 2009/004; A45F 3/02; A45F 3/04

USPC ..... 224/153, 581–583, 642, 644, 653

See application file for complete search history.

(56) References Cited

U.S. PATENT DOCUMENTS

| | | | | |
|---|---|---|---|---|
| 4,515,300 | A * | 5/1985 | Cohen | A45C 1/04 224/153 |
| 5,799,851 | A * | 9/1998 | Wulf | A45C 7/0045 224/580 |
| 2002/0113102 | A1 | 8/2002 | Klamm | |
| 2006/0175367 | A1* | 8/2006 | Khorshid | A45F 3/042 224/264 |
| 2012/0285124 | A1* | 11/2012 | Hagger | A45C 3/00 53/473 |

(Continued)

FOREIGN PATENT DOCUMENTS

| | | |
|---|---|---|
| DE | 40 40 792 | 6/1992 |
| EP | 2 387 908 | 11/2011 |

(Continued)

OTHER PUBLICATIONS

European Search Report for European Application No. 14165009.3, European Patent Office, The Hague, dated Oct. 8, 2014, 6 pages.

*Primary Examiner* — Justin Larson
*Assistant Examiner* — Phillip Schmidt
(74) *Attorney, Agent, or Firm* — Sterne, Kessler, Goldstein & Fox P.L.L.C.

(57) ABSTRACT

A lid of a backpack is disclosed having a compartment in which a standalone daysack having a shoulder strap is arranged. The compartment is transformable from a first state in which the lid is mountable to a backpack to a second state in which the standalone daysack is usable independently from the backpack. In the first state, the standalone daysack and its shoulder strap are stored within the compartment. In the second state, the compartment is inverted by turning the inside out so that the shoulder strap is usable for carrying the standalone daysack.

14 Claims, 6 Drawing Sheets

(56) References Cited

U.S. PATENT DOCUMENTS

| | | | | |
|---|---|---|---|---|
| 2015/0181994 | A1* | 7/2015 | Ponx | A45C 3/10<br>150/118 |

FOREIGN PATENT DOCUMENTS

| | | | | | |
|---|---|---|---|---|---|
| GB | 2 241 880 | | 9/1991 | | |
| GB | 2241880 | A * | 9/1991 | | A45F 3/00 |
| GB | 2460282 | | 11/2009 | | |
| GB | 2528095 | A * | 1/2016 | | A45C 7/0086 |

* cited by examiner

LID OF A BACKPACK

BACKGROUND

The present subject matter relates to a lid of a backpack and a backpack.

Known backpacks comprise a lid for opening and closing a main body of a backpack in which usually equipment for camping and the like is stored. Such a lid is constructed as a small standalone daysack and as a summit backpack, respectively. For using the lid as a summit backpack the lid is demounted from the backpack and straps used for mounting the lid to the backpack are used as shoulder straps. Thus, it is possible to use a lid in two different ways, namely as a lid connected to the main body of a backpack and as a standalone daysack and summit backpack, respectively.

Such a two way usage allows a user of a backpack also to carry along a small standalone daysack for e.g. daytrips for which, for example, food, water, and additional clothing, and so on can be stored only for the daytrip.

SUMMARY

The present subject matter relates to a lid of a backpack and a backpack.

According to an embodiment of the present subject matter, a lid of a backpack comprises a compartment in which a standalone daysack is arranged, wherein preferably the standalone daysack comprises a shoulder strap and at least one shoulder strap, respectively.

Thus, within a compartment of a backpack's lid a daysack is positioned for e.g. a daytrip for which only food, water, and some additional clothing is used needed for the daytrip. In contrast thereto, the backpack is used for e.g. equipment, food, clothing and so on needed for e.g. an excursion over several days.

Thus, the term "backpack" as understood herein, means a technical pack for e.g. trekking, hiking, multi-day backpacking or expedition, wherein the backpack is used over several days and at least two days, respectively.

In contrast thereto, under the term "daysack" and "standalone daysack", respectively, a rucksack is understood having a normal size for storing e.g. food and water for a day-trip.

Thus, the terms "backpack" and "standalone daysack" address the differences volume for storing and length of the trip. Hence, the main differences between "backpack" and "standalone daysack" are their size and the use for one or several days.

Moreover, it is preferred that the compartment is transformable from a first state to a second state. Advantageously, in the first state the lid is mountable to a backpack. By this, the lid is normally used as a closure for a main body of a backpack, wherein preferably the backpack is used for at least two days.

Further, it is preferred that in the second state the standalone daysack is usable independently from the backpack. By this, the lid can be demounted from the backpack and independently used. Hence, a second backpack and standalone daysack (also further denoted as rucksack, daysack or summit backpack), respectively, for a day trip is obtained.

Advantageously, in the first state the standalone daysack comprises a shoulder strap and at least one shoulder strap, respectively. Ideally, in the first state the standalone daysack is stored within the compartment of the lid. Thus, in the first state the standalone daysack and its shoulder strap can be stored within the compartment.

Preferably, in the second state the compartment is inverted by turning the inside out. By this, the shoulder strap becomes usable for carrying the standalone daysack. Hence, the transformed lid can be used as a standalone daysack for a daytrip in which for example food, water and special clothing are stored for e.g. a day-trip.

Describing the above mentioned in other words, a lid of a backpack can be transformed from a first state in which the lid closes a main body of the backpack to a second state in which the lid is a standalone daysack.

This transformation is done by inverting the lid due to turning the inside out. A main body of the standalone daysack is stored within the lid. This main body gets out of the lid's inside by turning the inside out. Thus, the standalone daysack becomes usable for carrying.

Such transformation has the advantage that the lid and its compartment, respectively, can comprise a totally different form and shape, respectively, as well as a totally different size comparing the first and the second state of the lid and the standalone daysack, respectively.

Thus, it is preferred that the lid and its compartment, respectively, in the first state, can be transformed in the second state in which the transformation results in a standalone daysack. Comparing the first with the second state the size of the lid's compartment and the standalone daysack differ, wherein the standalone daysack comprises a larger volume with regard to the compartment. Thus, the volume and the space, respectively, within the lid is smaller than the volume and the space, respectively, within the standalone daysack. Hence, the transformation enhances and enlarges, respectively, the usable space.

Further and as already mentioned, by transforming from the first to the second state the shape and form, respectively, of the lid and the standalone daysack differ. While the shape of the lid is adapted to close the opening of the main body of a backpack, the shape of the standalone daysack is adapted to a convenient way of carrying.

Summarizing the above, the mentioned transformation from the first to the second state changes the shape and the size such that the lid adapted to close an opening of a backpack can be used after transformation as a standalone daysack having a large volume and space, respectively, in comparison to the lid and its compartment, respectively.

According to an embodiment of the present subject matter, the standalone daysack preferably comprises a main part. This main part ideally forms part of the standalone daysack. Advantageously, in the first state the main part of the standalone daysack is stored in the compartment. Thus, an easy and space saving manner for realizing a standalone daysack is obtained. Further, it is preferred that the main part, in particular in the first state, in which the main part is stored in the compartment, is in a folded condition. By this, the aforementioned advantage, namely space saving, can be easily realized.

According to an embodiment of the present subject matter, the standalone daysack preferably comprises a lid part. Advantageously, the lid part is formed by the inverted compartment of the lid which is in the second state. Hence, by inverting the lid's compartment from the first to the second state the compartment is transformed to the lid part which is then usable as part and forms part, respectively, of the standalone daysack.

According to an embodiment of the present subject matter, in the first state the compartment advantageously comprises a section in which the standalone daysack is stored. By this, a storage room for the daysack is realized. Preferably, the compartment comprises a further section. An embodiment in which a lid's compartment comprises two sections has the advantage that e.g. in a first section the standalone daysack can be stored, whereas in the second section a storage space is located for e.g. things for trekking or storing in a backpack. Thus, by dividing the lid's compartment into two sections the storage space of the lid can be enhanced as the standalone daysack has its own section.

According to an embodiment of the present subject matter, the compartment comprises an opening, preferably positioned between the section and the further section. The opening has the function to grant access to the inside of the compartment and to allow the lid as well as its compartment to easily transform from the first state into the second state.

According to an embodiment of the present subject matter, the opening preferably is closable and/or openable. This can be easily realized by using a zipper or a snap button, wherein the opening preferably comprises the zipper or the snap button.

According to an embodiment of the present subject matter, the opening preferably extends such on the lid that the compartment is transformable from the first state into the second state and vice versa. This means that the opening is adapted to allow the transformation from the first state into the second state which is done by turning the inside out of the lid's compartment. Preferably, the opening extends along the width of the lid. This is an easy and cost effective way for allowing and granting, respectively, the transformation of the lid.

According to an embodiment of the present subject matter, the compartment comprises a divider, preferably separating the section and the further section so that the standalone daysack is stored only in the section. By this, the standalone daysack can be restricted to the section of the lid's compartment. Thus, by dividing the lid's compartment by the divider a separated space for the standalone daysack in the section and for hosting e.g. food, water, first aid material and so on in the further section is obtained. So, by using the divider a barrier dividing the section and the further section is realized.

According to an embodiment of the present subject matter, the divider preferably comprises mounting means for securing the position of the divider within the compartment. Advantageously, the compartment is in the first state. Thus, the lid's compartment can easily hold the standalone daysack in a folded condition within the section. So, the further section can be free for hosting e.g. food, first aid material and so on. Preferably, the divider's mounting means are realized by a zipper or a snap button. Of course, it is possible that the mounting means are positioned along the edges of the divider to allow an easy and comfortable connection with the compartment.

Further, it is preferred that the mounting means comprise a part and a counterpart or more precisely, a male and a female part, wherein one part is located at the compartment and another one at the divider. By this, an easy and reliable connection between the divider and the compartment is realized.

Even further, it is also possible that the divider comprises a first and a second area located opposite to each other, wherein the second area is sewed with the compartment and the first area comprises a mounting means as discussed before, e.g. a zipper or snap button. It is also possible that the first and second area comprise each mounting means so that the divider is detachably mounted to the lid.

According to an embodiment of the resent subject matter, the standalone daysack preferably comprises a further opening giving access to the interior of the standalone daysack. Thus, equipment for e.g. a summit using the standalone daysack and the summit backpack, respectively, can be easily stored in the interior of the daysack by loading equipment through the further opening.

It is a further advantage that the standalone daysack and its further opening, respectively, is openable and closable. A lightweight, easy and reliable construction can be for example the use of a pull cord and a cord lock. It is preferred that the pull cord is guided in a channel formed by the main body and the main part, respectively, of the standalone daysack at the further opening. Ideally, the channel circulates around the further opening of the standalone daysack, wherein the channel preferably comprises a gap interrupting the channel.

At each end of the gap preferably a cord lock is installed. A pull cord is optimally guided through the channel of the standalone daysack and through the cord lock. By pulling the pull cord the further opening of the standalone daysack and its main part, respectively, is closed. By positioning the cord locks at the borders of the gap the distance between the cords locks is reduced, wherein the cord locks restrict the pull cord to return. Thus, the further opening is closed. For releasing the further opening of the standalone daysack a user has to open the cord locks and to increase the distance between the cord locks. Hence, the opening of the standalone daysack is opened. Of course, it is possible that there is only one cord lock preventing a relative movement of the pull cord to the cord lock, wherein the pull cord forms a loop. The loop comprises a circumference which corresponds to the further opening. The smaller the circumference of the loop, the smaller the further opening. Further, the larger the circumference of the loop the larger the further opening.

According to an embodiment of the present subject matter, the inverted compartment preferably forms a lid part of the standalone daysack. This is preferably made in the second state. Further, it is advantageous that the standalone daysack further comprises a main compartment which forms a main part of the standalone daysack. By this, it becomes evident that the standalone daysack ideally comprises two parts, namely a lid part and a main part, wherein the main part was stored in the first state in the non-inverted compartment of the lid, and wherein the lid part is the inverted compartment of the lid. Thus, after transforming the lid's compartment from the first state to the second state a standalone daysack is obtained having two parts, namely the lid part and the main part. By the way, the transformation of the lid's compartment from the first state to the second state forms an inverted compartment.

Advantageously, the lid part forms the inverted compartment and the main part form the main compartment. Preferably, both compartments are not in communication with each other. Thus, a subject stored in the main part and the main compartment, respectively, of the standalone daysack cannot get to the lid part and the inverted compartment, respectively. This also applies vice versa. Thus, the inverted compartment and the main compartment are separated and are in a separated condition, respectively.

According to an embodiment of the present subject matter, preferably the lid part and the main part are separated by connecting means and disconnecting means, respectively. Advantageously, the lid part and the main part (both compartments) are connectable, such that the volume of the main compartment of the standalone daysack is enlarged by the volume of the inverted compartment.

In other words, it is preferred that the main compartment of the standalone daysack comprises a portion which is shared with the inverted compartment of the lid in the second state. This shared portion and shared bottom, respectively, ideally comprises the connecting means which are preferably realized as a zipper or as a snap button. By opening the connecting means the volume of the main compartment of the standalone daysack and the volume of the inverted compartment of the lid are connected such that a standalone daysack is realized having one large compartment. Thus, by opening the zipper the two volumes of the compartments are connected to one volume. Using the connecting means depends on the user's preference to have one big volume or two smaller volumes and compartments, respectively.

According to an embodiment of the present subject matter, the shoulder strap is preferably connected to the standalone daysack. More precisely, it is preferred that the shoulder strap is connected to the parts (main part, lid part) of the standalone daysack. By this, the lid can quickly be transformed to a standalone daysack, wherein time is efficiently saved as there is no need to mount the shoulder strap to the standalone daysack. Preferably, a shoulder strap comprises two ends, wherein at least one end is connected to the standalone daysack. Advantageously, two shoulder straps are connected to the standalone daysack so that transforming can easily and quickly be done.

According to an embodiment of the present subject matter, the main part preferably comprises a baggy shape in an unfolded condition in which the standalone daysack is usable. Such a baggy shape is easily realized and provides efficient volume for the standalone daysack. Of course, further shapes such as a polygonal shape, a rectangular shape can also be realized.

According to an embodiment of the present subject matter the compartment comprises a pad. Such a pad provides a soft contact of the standalone daysack and it's outside, respectively, with a contact surface of the user. Further, it is preferred that the pad is held in position in the second state of the lid at the same side as the shoulder strap. By this a predetermined position in the second state of the lid is realized so that the pad can protect e.g. the back of a user. Preferably, the shoulder strap is connected to the parts (main part, lid part) of the standalone rucksack. By this, the shoulder strap is connected to the standalone rucksack so that transforming can easily and quickly be done.

According to a further aspect of the present invention a backpack comprises preferably a lid as mentioned above. Thus, the lid of the backpack can be used e.g. a summit backpack or as a daysack. Preferably, the backpack comprises means for connecting the lid to the backpack. Thus, the lid is easily adjustable and usable in connection with a backpack. The lid is ideally connected to the backpack by side release buckles.

For the sake of completeness it is noticed that, of course, it is possible to transform the daysack from the second state back to the first state in which the daysack is a lid of a backpack. Thus, all explanations made above also apply for the other way round, namely for transforming from the second to the first state.

DETAILED DESCRIPTION

In the following an embodiment of the present subject matter is explained based on the drawings. It is noticed that the drawings show a specific embodiment as explained below and further alternative modifications as specified in the description are at least in part not illustrated. Further, same reference signs used in the Figures denote same components.

As a preliminary point, the preceding description is in the following shortly summarized. A lid 1 of a backpack 30 is described below, wherein the lid 1 has a compartment 2 in which a standalone daysack 10 is arranged. The compartment 2 is transformable from a first state S1 in which the lid 1 is mountable to a backpack 30 to a second state S2 in which the standalone daysack 10 is usable independently from the backpack 30. In the first state S1 the standalone daysack 10 is stored within the compartment 2, wherein in the second state S2 the compartment 2 is inverted by turning the inside out so that the standalone daysack 10 is usable.

Figure 1:
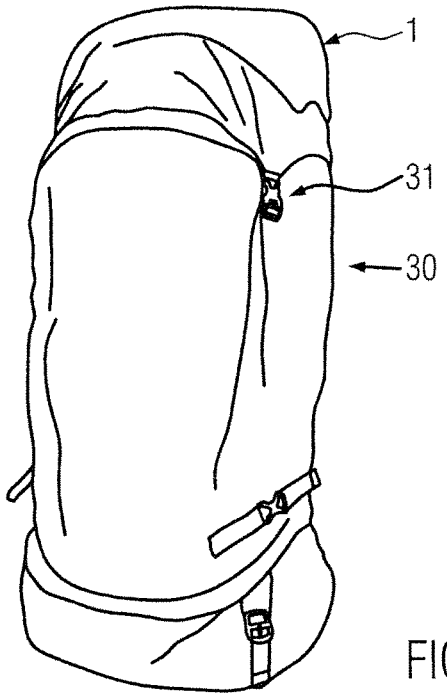
FIG. 1 shows a three-dimensional view of a backpack having a lid.

In FIG. 1 a three-dimensional view of a backpack 30 and a lid 1 is shown. The lid 1 is positioned on the top of backpack 30 and connected to the backpack 30 by means and side release buckles 31, respectively. The side release buckles 31 allow an easy, cost efficient and reliable way to connect the lid 1 to the backpack 30. Further, such buckles allow quickly installing and uninstalling the lid 1 from and to the backpack 30.

Figure 2A:
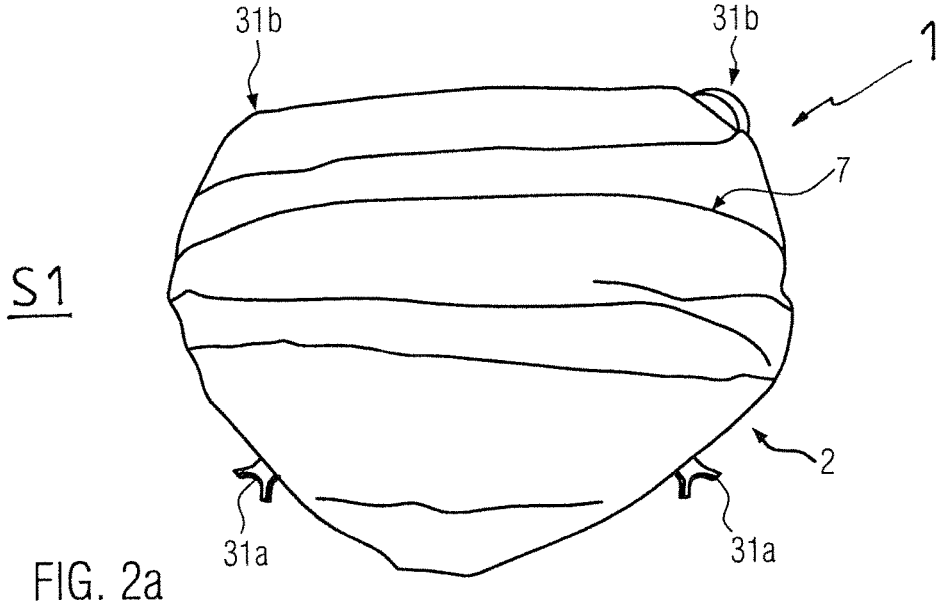
FIG. 2*a* shows the lid of FIG. 1 from the top demounted from the backpack.

FIG. 2*a* shows the lid 1 from the top demounted from the backpack 30 and thus, in a first state S1 in which the lid 1 is mountable to a backpack. The lid 1 has a compartment 2 in which a standalone daysack 10 comprising a shoulder strap 4 is arranged (not shown). The compartment 2 comprises an opening 7 (not clearly visible in FIG. 2*a*). Further, a part of the side release buckles 31 is also depicted, wherein the shown part is the female counterpart 31*a*. On the top a male part 31*b* of further side release buckles 31 can be seen, also allowing a connection between the lid 1 and the backpack 30. Thus, on every corner of the lid 1 a side release buckle 31 is installed guaranteeing a reliable connection to the backpack 30.

Figure 2B:
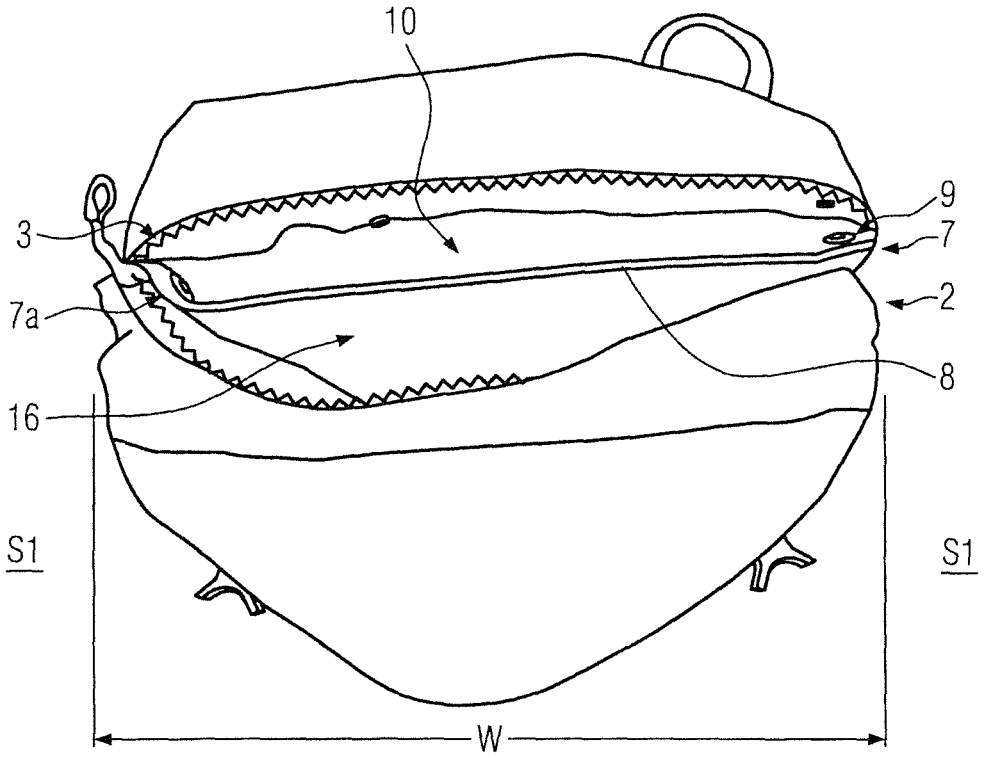
FIG. 2*b* shows the interior of the lid depicted in FIG. 2*a;*

In FIG. 2*b* the same lid 1 as shown in FIG. 2*a* is depicted. The lid 1 is still in the first state S1. However, in FIG. 2*b* the opening 7 is identifiable and shown. The opening 7 is released by using a zipper 7*a* so that the inside of the compartment 2 is visible. The zipper 7*a* and the opening 7, respectively, extends along the width W of the lid 1, wherein the length of the zipper corresponds to the width W of the lid 1.

Partly anticipating the following explanation, it is noticed that the length of the opening 7 and the zipper 7*a*, respectively, can also be longer or shorter in comparison to the width W of the lid 1. Thus, e.g. the more the zipper's length corresponds to the lid's width, the transformation from the first state S1 to the second state S2 of the lid is easier. In this context, it is preferred that the length of the opening is mainly equal to the width of the lid. In other words, the opening 7 extends such on the lid 1 that the compartment 2 is transformable from the first state S1 to the second state S2 and vice versa.

The compartment 2—as shown in FIG. 2*b*—comprises in the first state S1 two sections 3, 16. The section 3 and the first section 3, respectively, stores in its inside the standalone daysack 10. The further section 16 of the compartment 2 and the second section, respectively, is empty so that it is possible to store e.g. food, first aid material and so on in its inside. Between the section 3 and the further section 16 the opening 7 is positioned. Thus an easy access to both sections is realized.

As also can be seen within the compartment 2 a divider 8 is arranged. The divider 8 separates the section 3 and the further section 16. Moreover, the divider 8 holds the standalone daysack 10 in section 3 and thus prevents the daysack 10 from unattended falling out of the compartment 2 when releasing the opening 7.

The divider 8 and the compartment 2 of the lid 1, respectively, comprises mounting means and snap buttons 9, respectively, for securing the position of the divider 8 within the compartment 2. Each snap button 9 comprises a male and a female part, wherein the female part is located at the compartment 2 and the male part at the divider 8. Snap buttons 9 allow an easy, quick and reliable connection between the divider 8 and the compartment 2.

As can be further seen by FIG. 2*b* the divider 8 comprises a first upper and a second lower area, wherein the terms "upper" and "lower" refer to the orientation of the lid shown in FIG. 2*b*. The second lower area is sewed with and part of, respectively, the compartment 2. The first upper area located next to zipper 7*a* and the opening 7 comprises the snap buttons 9 as discussed above. It is also possible that the second lower area also comprises mounting means such as snap buttons or a zipper. By this, the divider 8 can be completely demounted from the lid 1.

The releasing of the opening 7 and the zipper 7*a*, respectively, is the first step for transforming the lid 1 to a daysack 10. As a next step, the daysack 10 is pulled out of the compartment 2.

Figure 2C:
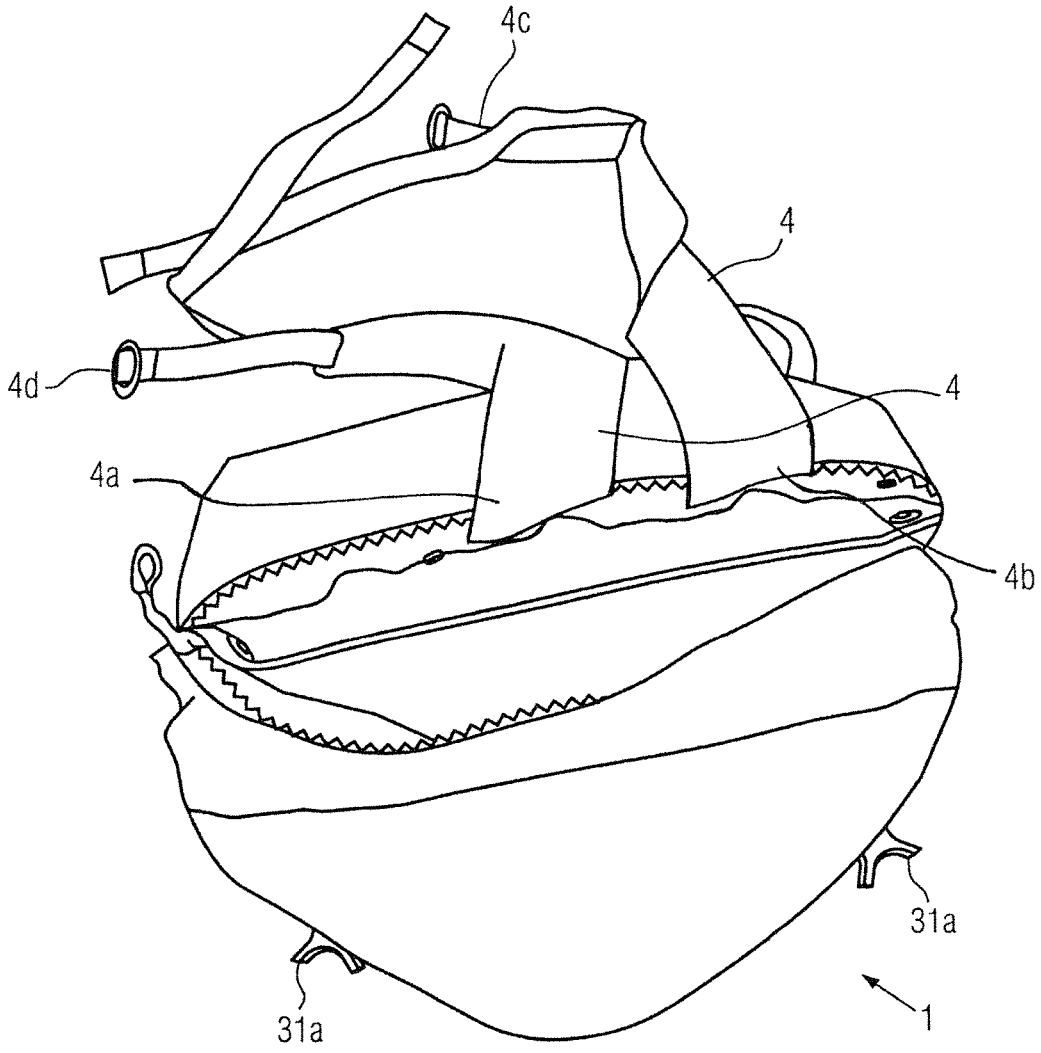
FIG. 2*c* shows a part of a daysack pulled out of the lid of FIG. 2*b;*

FIG. 2*c* shows that a part of the daysack 10 is still in the section 3 and another part of the daysack is located outside the compartment 2 and the section 3, respectively. As can be seen in this figure the daysack 10 also comprises two shoulder straps 4 which are partly arranged within the compartment 2 and partly located outside as an intermediate state between the first and the second state S1, S2.

The shoulder straps 4 comprise each a free end 4*c*, 4*d* and a fixed end 4*a*, 4*b*. The free ends 4*c*, 4*d* are for connecting to the daysack 10 so that the straps become usable for carrying the rucksack and daypack, respectively. The free ends 4*c*, 4*d* comprise each a buckle for quickly mounting the ends to the daysack 10. A corresponding counterpart interacting with the buckles is fixed to the daysack 10 and serves for detachably mounting the buckles at the ends 4*c*, 4*d* of the shoulder straps 4. Further, the fixed ends 4*a*, 4*b* are—not shown in FIG. 3*a*—sewed to the daysack 10, so that their position relative to the daysack 10 is fixed.

In an embodiment the shoulders straps 4 are completely detachable from the daysack 10. This allows e.g. a separate cleaning and washing, respectively, of the straps. Further, specially configured shoulder straps can be provided adapted to individually user's need. This for example could be shoulder straps specially adapted with regard to the width in the area of contact with the user or with regard to specially padded straps.

Figure 3A:
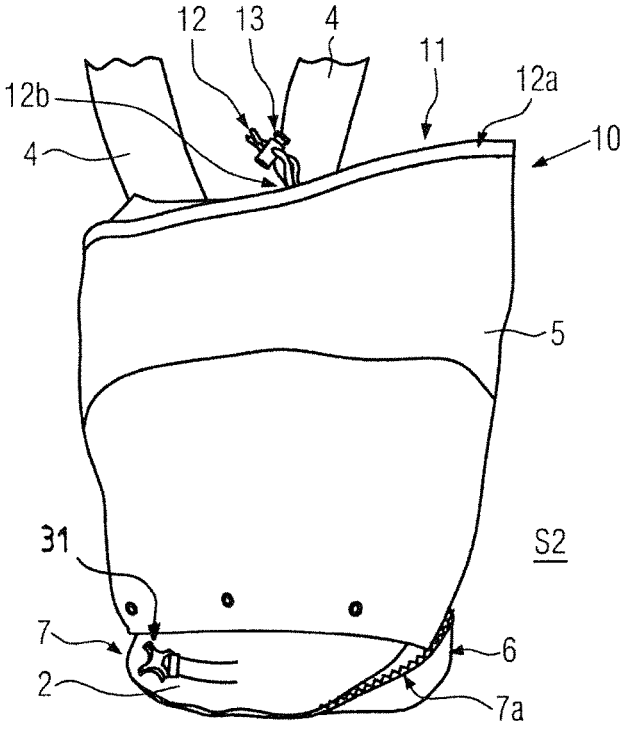
FIG. 3*a* shows the daysack completely outside the lid in the second state.

FIG. 3*a* shows the daysack 10 completely outside the compartment 2 of the lid 1 in the second state S2. Thus, the transformation by turning the inside out of the lid 1 is completed, wherein now it is noticed that the lid 1 and its compartment 2, respectively, comprise a totally different form and shape, respectively, as well as a totally different size comparing the first and the second state S1, S2 of the lid 1 and the standalone daysack 10, respectively.

Further, the daysack comprises a main part 5 and a lid part 6. The main part 5 was stored in the lid's compartment 2, more precisely, in section 3 in a folded condition (see e.g. FIG. 2*b* or 2*c*). In FIG. 3*a* the main part 5 is in an unfolded condition in which the daysack 10 and its main part, respectively, has a baggy-like shape. In this unfolded condition the standalone daysack 10 is independently usable from the backpack as a standalone rucksack and daypack, respectively.

Further, the lid part 6 is the compartment 2 in the second state S2. This means that in the second state S2 the compartment 2 was transformed to the lid part 6 by turning the inside of the compartment 2 out. By this, in the second state S2 an inverted compartment 2 is obtained which forms part, namely the lid part 6, of the daysack 10 in the second state S2.

Thus, the daysack 10 comprises a main part 5 and a lid part 6 or in other words a main compartment 5 which forms the main part 5 of the standalone daysack 10 and an inverted compartment 2 which forms the lid part 6.

Figure 3B:
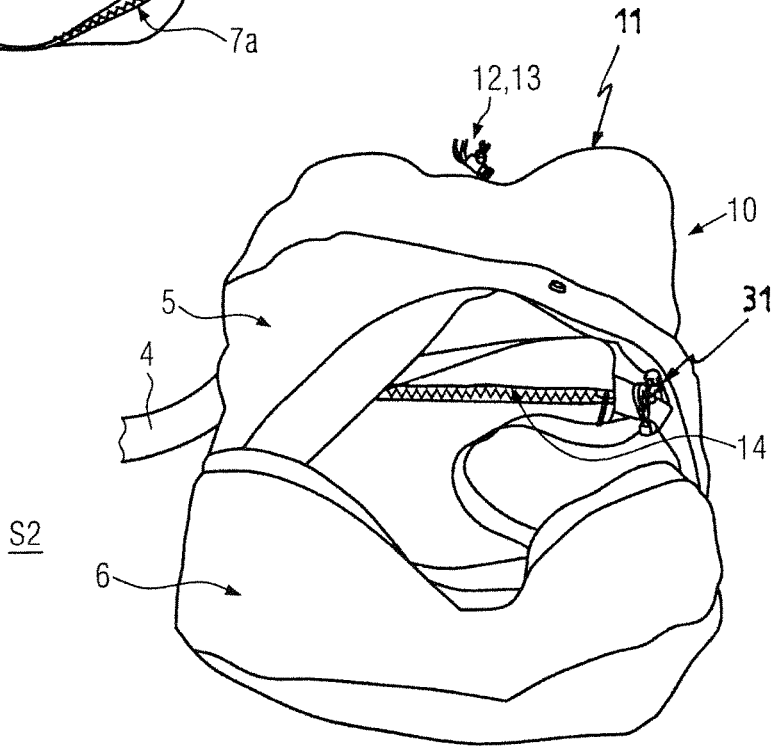
FIG. 3*b* shows the inside of the daysack in the second state.

Now referring to FIG. 3*b* in which the daysack 10 of FIG. 3*b* in the second state S2 is shown. FIG. 3*b* is mainly similar to FIG. 3*a*, wherein the inside of the daysack 10 can be seen in part. All explanations made for FIG. 3*a* also apply for FIG. 3*b*. Further, besides the side release buckles 31 and the female counterpart 31*a*, respectively, a connecting means 14 is depicted.

The two compartments, namely main compartment 5 and inverted compartment 2 can be separated and connected by the connecting means such which is realized in this embodiment as a zipper 14. This separation and connection, respectively, is no demounting or mounting of one part from or to another, but it is an enlarging or diminishing with regard to the size within the daysack 10.

Then, e.g. if the zipper 14 is closed the daysack 10 comprises in its interior two separate compartments (main and inverted compartment). Thus, equipment filled in the main compartment 5 cannot arrive in the inverted compartment 2 and lid part 6, respectively. Also the other way round, equipment filled in the inverted compartment 2 cannot arrive in the main compartment and the main part 5, respectively.

However, if both compartments (main 5 and inverted compartment 2) are connected by the connecting means 14 the volume of one compartment is increased by the volume of the other compartment, and thus, the internal volume of the standalone daysack 10 is in the condition in which the largest objects can be carried.

In other words, the main compartment 5 of the standalone daysack 10 comprises a portion which is shared with the inverted compartment 2 of the lid 1 in the second state S2. This shared portion and shared bottom, respectively, ideally comprises the connecting means 14 and the zipper, respectively. By opening the zipper 14 the volume of the main compartment 5 of the standalone daysack 10 and the volume of the inverted compartment 2 of the lid 1 are connected such that the standalone daysack 10 has one large compartment. Thus, by opening the zipper 14 the two volumes of the compartments 2, 5 are connected to one volume. Using the zipper 14 depends on the user's preference to have one big volume or two smaller volumes and compartments, respectively.

In the second state S2 also the opening 7 or more precisely the also inverted opening 7 is shown in FIGS. 3*a* and 3*b*. This inverted opening 7 is also closable and openable as the non-inverted opening 7 as shown in FIGS. 2*a* to 2*c*. Thus, the compartment 2 as well as the inverted compartment 2 and the lid part 6, respectively, are accessible through the opening 7.

The zipper 7*a* installed for opening and closing the compartment 2 functions in the same way in both states S1, S2. Hence, the zipper 7*a* is usable in the first and second state to open and lock the opening 7. In this context, it is noticed that instead of the zipper also snap buttons can be used for which it also doesn't matter whether they are used in an inverted or non-inverted state of the compartment 2.

While the opening 7 having the zipper 7*a* is located at the bottom of FIGS. 3*a*, 3*b* a further opening of the standalone daysack 10 is located mainly opposite at the top of FIGS. 3*a*, 3*b* in an open condition. Thus, the standalone daysack 10 has the further opening 11 which gives access to the interior. This further opening 11 comprises a pull cord 12 and a cord lock 13 by which the further opening 11 is openable and closable. Such a construction is lightweight, easy and reliable.

The pull cord 12 is guided in a channel 12*a* formed by the main part 5 of the standalone daysack 10 at the opening 11. The channel circulates around the opening 11, wherein the channel 12*a* comprises a gap 12*b* interrupting the channel. At the gap the cord lock 13 is installed. The pull cord is guided through the channel 12*a* as well as through the cord lock 13. Thus, the pull cord forms a closed loop, wherein the length and circumference, respectively, of the pull cord is variable by opening and closing the cord lock 13.

By pulling the pull cord 12 in a direction away from the daysack 10, the further opening 11 of the standalone daysack 10 and its main part 5, respectively, is closed. Hence, the cord lock 13 arrests the loop's circumference of the cord lock 13. For releasing the further opening 11 of the standalone daysack 10 the cord lock has to be unlocked. By unlocking the circumference of the loop the further opening 11 of the standalone daysack 10 can be opened as now the loop's circumference can be increased by pulling the loop.

Figure 3C:
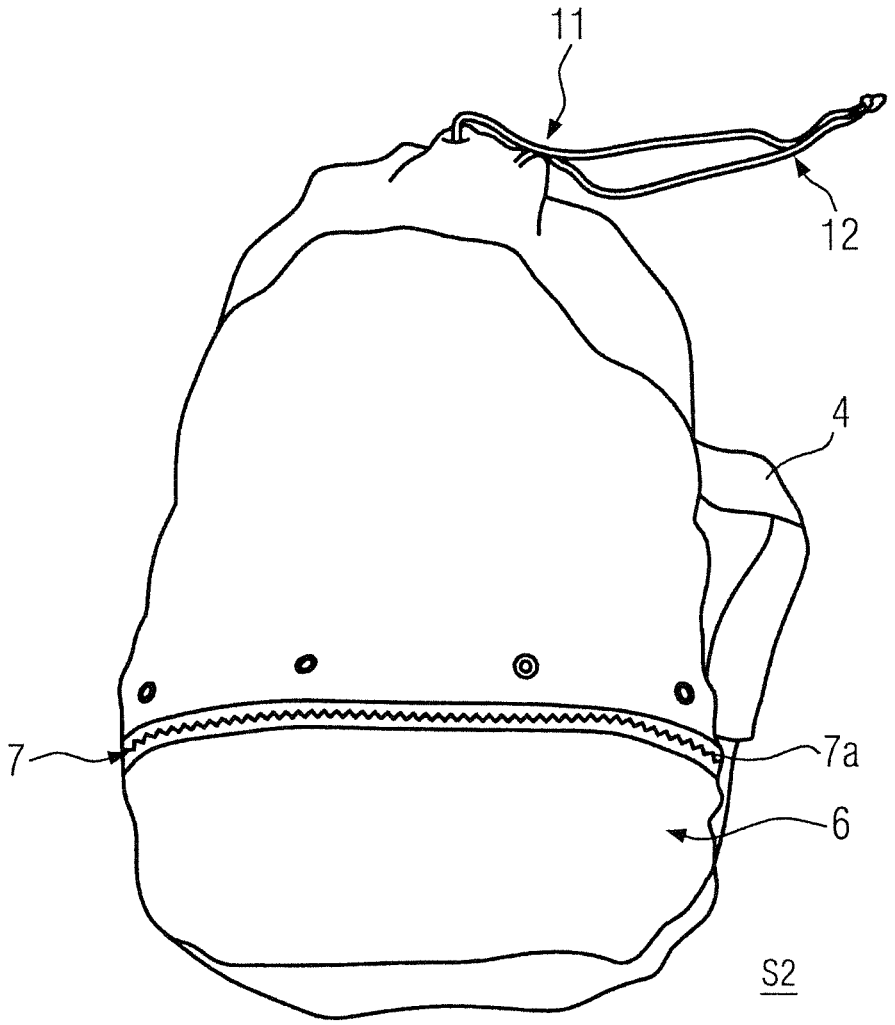
FIG. 3*c* shows the daysack in the second state.

Whereas in FIGS. 3*a*, 3*b* the opening 7 and the further opening 11 are in an open condition, wherein the standalone daysack 10 is in the second state S2, in FIG. 3*c* the daysack 10 comprises the opening 7 and the further opening 11 in a closed condition, wherein the standalone daysack 10 is still in the second state S2.

Thus, in FIG. 3*c* in which the further opening 11 is closed the circumference of the pull cord 12 and the loop, respectively, is shorter than in comparison to the circumference shown in FIGS. 3*a*, 3*b* in which the further opening 11 is open.

Figure 4A:
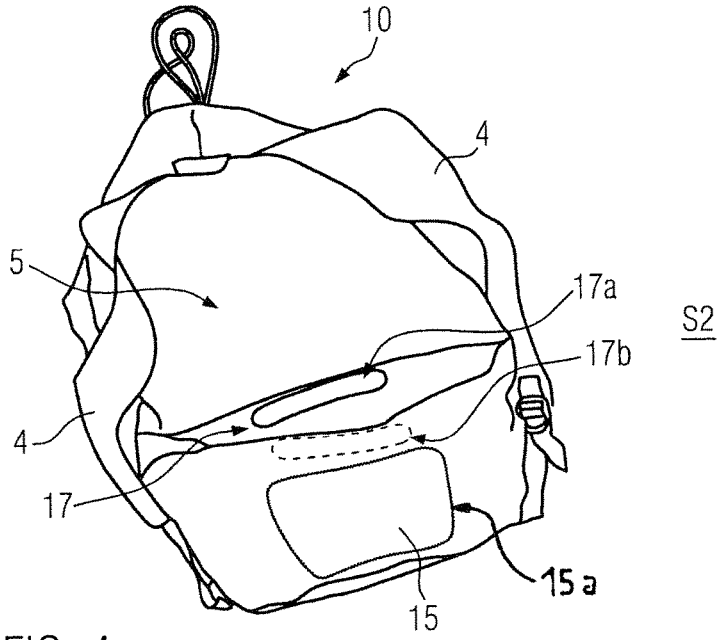
FIG. 4*a* shows the back of the standalone daysack.
Figure 4B:
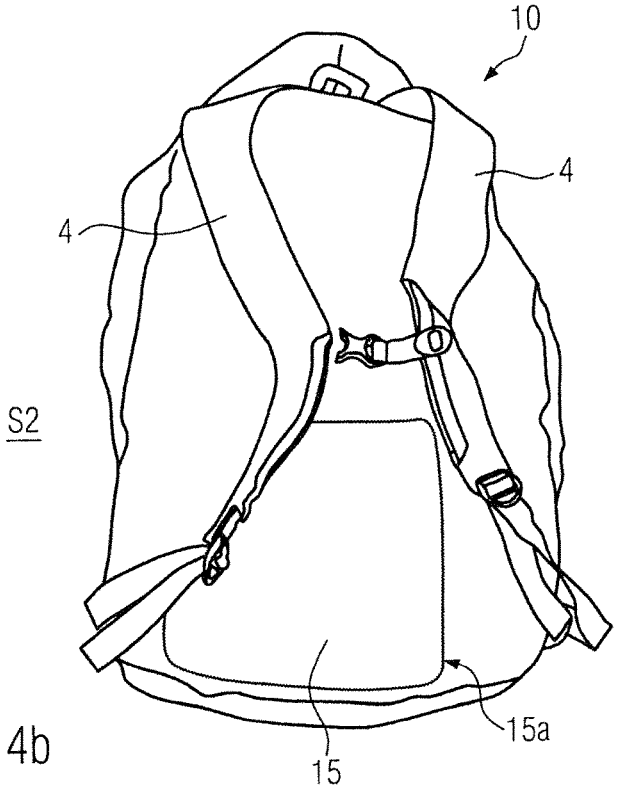
FIG. 4*b* shows a further back view of the standalone daysack.

FIGS. 4*a* and 4*b* show the back of the standalone daysack 10. Here, the shoulder straps 4 are mounted to the standalone daysack 10. In FIG. 4*a* a pad 15 and its contour 15*a*, respectively, is shown.

Such a pad 15 provides a convenient wearing comfort of the standalone daysack and it's outside, respectively, in particular at a contact surface with a user. The pad 15 which in the first state S1 is located within the compartment 2 of the lid 1 is in the second state S2 positioned on the outside of the inverted compartment 2. However, for providing an optimal wearing comfort, in particular at the back of the user contacting the standalone daysack 10 the pad 15 should be located at a predetermined position.

This is realized by a hook and loop fastener 17 having a male 17*b* and a female part 17*a*. The male part 17*b* of the hook and loop fastener in the first state S1 is positioned at the inside of the compartment 2 and in the second state S2 it gets outside due to turning inside out of the compartment 2. The female part 17*a* of the hook and loop fastener 17 is located at the outside of the main part 5 of the standalone daysack 10 and thus is only accessible in the second state S2 in which the main part 5 of the daysack 10 is outside the compartment 2 due to inverting. Thus, after inverting the compartment 2 and the lid 1, respectively, the male 17*b* and female part 17*a* of the hook and loop fastener 17 can be connected so as to adjust the position of the pad 15.

By connecting the male with the female part the pad 15 which is connected to the compartment 2 and the inverted compartment 2, respectively, arrives at a predetermined position at the back of the standalone daysack 10 so that a user's back can be optimally protected. Thus, protection as well as an optimal wearing comfort can be provided to the daysack's user.

Summarizing the above, the pad 15 is held in position in the second state S2 of the lid 1 at the same side as the shoulder straps 4 by use of a the hook and loop fastener 17. By this, a predetermined position of the pad 15 in the second state S2 of the lid 1 is realized so that the pad 15 can protect e.g. the back of a user while wearing the daysack 10.

LIST OF REFERENCE SIGNS

1 lid
2 compartment, inverted compartment
3 section
4 shoulder strap
4*a, b* fixed end of shoulder strap
4*c, d* free end of shoulder strap
5 main part, main compartment
6 lid part
7 opening
7*a* zipper
8 divider
9 mounting means; snap button
10 standalone daysack
11 further opening
12 pull cord
12*a* channel
12*b* gap
13 cord lock
14 connecting means
15 pad
15*a* contour of pad
16 further section
17 hook and loop fastener
17*a* female part of hook and loop fastener
17*b* male part of hook and loop fastener
30 backpack
–means, side release buckles
W width
S1 first state
S2 second state

The invention claimed is:

1. A backpack comprising:

a lid and a main body, the lid configured to close the main body, and the lid comprising:

a compartment comprising a first internal section in which a standalone daysack comprising a shoulder strap is arranged and a second internal section separated from the first internal section by a divider, and an opening configured to provide access to the first internal section and the second internal section of the compartment;

wherein the compartment is transformable from a first state in which the lid is mountable to the backpack to a second state in which the standalone daysack is usable independently from the backpack, wherein in the first state the lid is configured as a closure for the main body of the backpack, and the standalone daysack and its shoulder strap are stored within the first internal section of the compartment of the lid, wherein in the second state the compartment is inverted by turning the compartment inside out so that the shoulder strap is usable for carrying the standalone daysack, and wherein the backpack comprises means for connecting the lid to the backpack.

2. The backpack according to claim 1, wherein the standalone daysack further comprises a main part, wherein in the first state the main part of the standalone daysack is stored in the first internal section of the compartment in a folded condition.

3. The backpack according to claim 2, wherein the main part comprises a baggy shape in an unfolded condition in which the standalone daysack is usable.

4. The backpack according to claim 1, wherein the standalone daysack further comprises a lid part formed by the inverted compartment which is in the second state.

5. The backpack according to claim 1, wherein the divider comprises mounting means for securing the position of the divider within the compartment in the first state.

6. The backpack according to claim 1, wherein the opening is closable and openable and comprises a zipper or a snap button.

7. The backpack according to claim 1, wherein the opening extends such on the lid that the compartment is transformable from the first state in the second state and vice versa, wherein the opening extends along the width of the lid.

8. The backpack according to claim 1, wherein the standalone daysack comprises a further opening giving access to the interior, wherein the standalone daysack is openable and closable by a pull cord and a cord lock.

9. The backpack according to claim 1, wherein the inverted compartment forms a lid part of the standalone daysack in the second state, wherein the standalone daysack further comprises a main compartment which forms a main part of the standalone daysack, and wherein the inverted compartment and the main compartment are separated.

10. The backpack according to claim 9, wherein the inverted compartment and the main compartment are separated by connecting means, wherein both compartments are connectable such that the volume of the main compartment of the standalone daysack is enlarged by the volume of the inverted compartment.

11. The backpack according to claim 1, whereinm the shoulder strap is connected to the standalone day sack.

12. The backpack according to claim 1, wherein the compartment comprises a pad which is held in position in the second state of the lid at the same side as the shoulder strap connected to the lid and main part of the standalone daysack.

13. The backpack of claim 1, wherein the divider is detachably- connected to the compartment.

14. A lid of a backpack, the lid comprising:

an invertible compartment in which a standalone daysack comprising a main compartment and a shoulder strap is arranged, the invertible compartment comprising an opening comprising a first connecting means configured to provide access to the invertible compartment, wherein the invertible compartment is transformable from a first state in which the lid is mountable to a backpack to a second state in which the standalone daysack is usable independently from the backpack, wherein in the first state the standalone daysack and its main compartment and shoulder strap are stored within the invertible compartment, and wherein in the second state the invertible compartment is inverted by turning the invertible compartment inside out so that the shoulder strap is usable for carrying the standalone daysack, wherein the inverted compartment forms a lid part of the standalone daysack in the second state, wherein the first connecting means couples the lid part to the main part of the standalone daysack in the second state, and wherein an internal volume of the lid part and an internal volume of the main compartment are separated by a second connecting means that is configured to:

separate the internal volume of the main compartment and the internal volume of the lid part in a closed position, and place the internal volume of the main compartment in communication with the internal volume of the lid part in an open position.

* * * * *